US009107525B1

(12) United States Patent
Ogle

(10) Patent No.: US 9,107,525 B1
(45) Date of Patent: Aug. 18, 2015

(54) UTILITY TRAY

(71) Applicant: Chuck R. Ogle, Weatherford, TX (US)

(72) Inventor: Chuck R. Ogle, Weatherford, TX (US)

( * ) Notice: Subject to any disclaimer, the term of this patent is extended or adjusted under 35 U.S.C. 154(b) by 0 days.

(21) Appl. No.: 14/504,147

(22) Filed: Oct. 1, 2014

Related U.S. Application Data

(60) Provisional application No. 61/885,214, filed on Oct. 1, 2013.

(51) Int. Cl.
*A47G 23/06* (2006.01)
*A47B 23/00* (2006.01)
*A45F 3/04* (2006.01)

(52) U.S. Cl.
CPC ..... *A47G 23/06* (2013.01); *A45F 2003/045* (2013.01); *A47B 23/002* (2013.01)

(58) Field of Classification Search
USPC ..... 224/270; 108/43
See application file for complete search history.

(56) References Cited

U.S. PATENT DOCUMENTS 4,700,634 A * 10/1987 Mills et al. ..... 108/43
5,074,222 A 12/1991 Welch
5,148,356 A * 9/1992 Freese et al. ..... 362/130
5,221,032 A 6/1993 Bott et al.
5,269,600 A * 12/1993 Arreola et al. ..... 312/348.3
5,421,499 A 6/1995 Bauer
5,688,037 A * 11/1997 Chen ..... 362/98
5,941,436 A 8/1999 Washington
6,006,970 A * 12/1999 Piatt ..... 224/257
6,216,931 B1 * 4/2001 Trawinski ..... 224/583
7,051,910 B2 * 5/2006 Sprague et al. ..... 224/638
7,495,163 B1 * 2/2009 Goodrich ..... 84/423 R
7,591,401 B2 9/2009 Sandler
8,109,421 B2 * 2/2012 McLean et al. ..... 224/270
2004/0200870 A1 * 10/2004 Haber ..... 224/259
2006/0054649 A1 * 3/2006 Tippmann ..... 224/625
2009/0294500 A1 * 12/2009 Brown et al. ..... 224/651
2013/0036949 A1 * 2/2013 Nguyen ..... 108/6

* cited by examiner

*Primary Examiner* — Justin Larson
(74) *Attorney, Agent, or Firm* — Kenneth L Tolar

(57) ABSTRACT

A tray includes a base panel having an upper surface, a lower surface, a front edge, a rear edge and two opposing side edges. Extending from the rear edge are a pair of U-shaped hooks that fasten to grommets on a front section of an adjustable belt. Suspenders are securable to eyelets on a rear section of the belt and to opposing side edges of the base panel. A sliding retaining wall secures smaller items that would otherwise shift when being transported on the base panel. Accordingly, the base panel is firmly supported in a horizontal position, adjacent to the user's waist, allowing various items to be conveniently transported thereon.

7 Claims, 4 Drawing Sheets

UTILITY TRAY

CROSS REFERENCE TO RELATED APPLICATIONS

This application is entitled to the benefit of provisional patent application No. 61/885,214 filed on Oct. 1, 2013, the specification of which is incorporated herein by reference.

BACKGROUND OF THE INVENTION

The present invention relates to a tray that is horizontally supported by suspenders and a belt to allow the wearer to easily transport items while walking.

DESCRIPTION OF THE PRIOR ART

A variety of workers, such as vendors or deliverers, manually transport objects between various locations. Often, such objects are heavy and bulky, and, therefore, exert a significant strain on the back and shoulders. Furthermore, when passing through doorways, the worker must repeatedly set the objects on a support surface, open or close a door and then retrieve the items, which is cumbersome and aggravating. Accordingly, there is currently a need for a device that assists certain workers with manually transporting items.

A review of the prior art reveals several wearable trays. For example, U.S. Pat. No. 5,074,222 issued to Welch discloses a body-supported tray including a pair of shoulder hooks with a tray table attached thereto. The tray table may be collapsed against the shoulder hooks for storage.

U.S. Pat. No. 5,221,032 issued to Bott discloses a tray that is supported on the torso of a wearer with an adjustable belt.

U.S. Pat. No. 5,421,499 issued to Bauer discloses a wearable tray including a pair of shoulder hooks with a table surface attached thereto.

U.S. Pat. No. 5,941,436 issued to Washington discloses a wearable tray assembly including a padded waistband that is firmly supported around a person's abdomen with a pair of shoulder straps. Either a box-shaped container or a flat tray may be removably secured to the waistband.

U.S. Pat. No. 7,591,401 issued to Sandler discloses a tray system attachable to a wearer with a pair of shoulder straps.

U.S. published patent application no. 2004/0200870 to Haber discloses a harness having a series of straps depending therefrom for supporting a laptop or similar item near a wearer's waist.

U.S. published patent application no. 2006/0054649 to Tippmann discloses a wearable and disposable food tray.

The present invention overcomes some deficiencies of the prior art by providing a tray that attaches to a belt with unique bolts to allow the tray to be pivoted upright in confined spaces. Furthermore, the tray according to the present invention includes suspenders that attach to each side of the tray for enhanced support and an adjustable band for varying the space between the suspenders. Finally, the tray includes a slidable divider with an LED module thereon for restraining smaller objects and illuminating the surrounding area.

SUMMARY OF THE INVENTION

The present invention relates to a tray comprising a base panel having an upper surface, a lower surface, a front edge, a rear edge and two opposing side edges. Extending from the rear edge are a pair of U-shaped hooks that fasten to grommets on a front section of an adjustable belt. Suspenders are securable to eyelets on a rear section of the belt and to opposing side edges of the base panel. Accordingly, the base panel is firmly supported in a horizontal position, adjacent to the user's waist, allowing items to be conveniently transported thereon.

It is therefore an object of the present invention to provide a utility tray that allows a user to easily transport items without occupying the hands.

It is another object of the present invention to provide a utility tray that assists certain workers with manually transporting objects.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
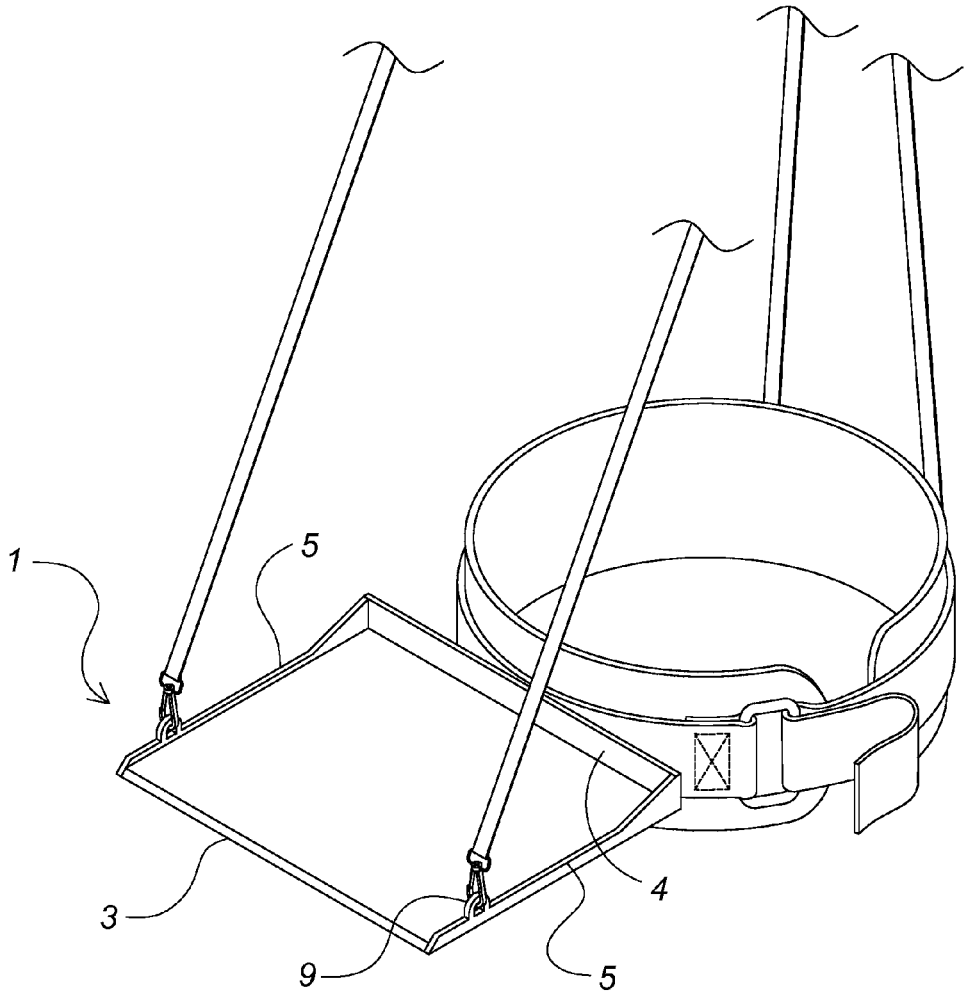
FIG. 1 is a perspective view of the utility tray according to the present invention.
Figure 2:
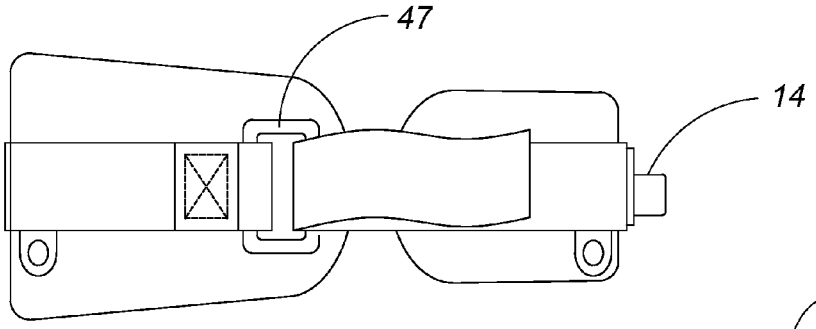
FIG. 2 is a sectional view of the belt.
Figure 6:
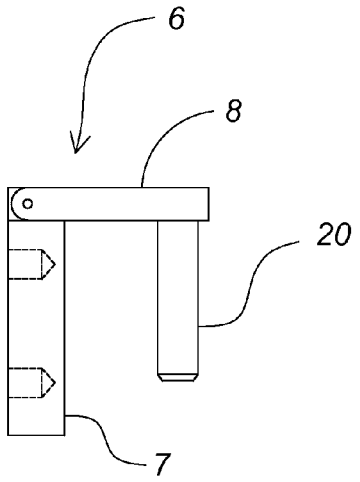
FIG. 6 is an isolated view of the pivotal hooks
Figure 3:
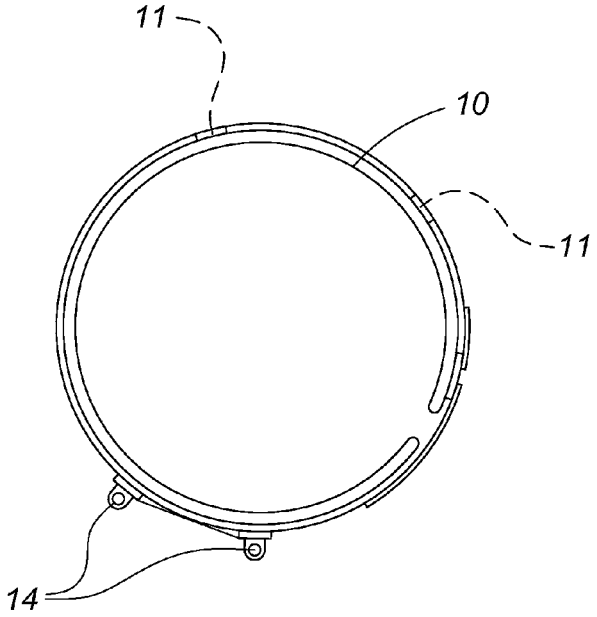
FIG. 3 is a top view of the belt.
Figure 4:
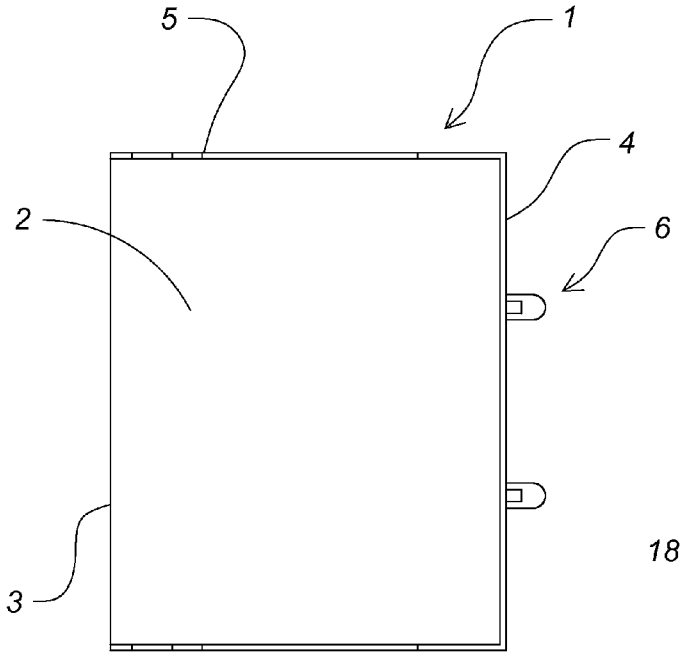
FIG. 4 is a top, plan view of the base panel.
Figure 7:
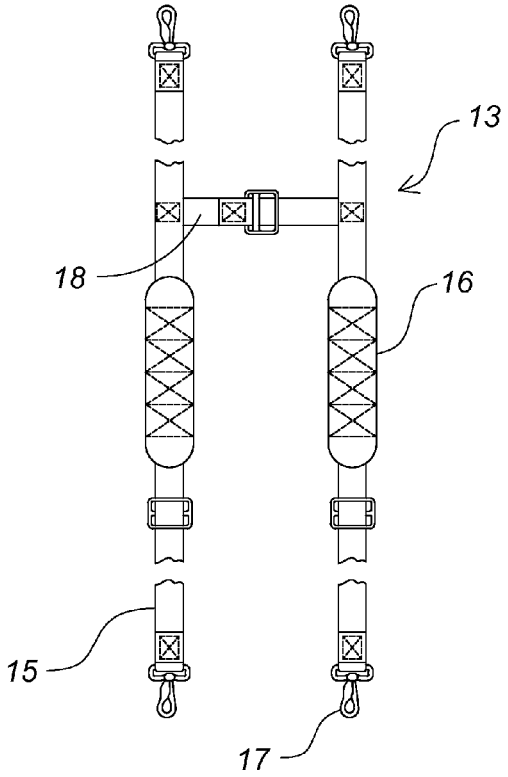
FIG. 7 is an isolated view of the suspenders.
Figure 5:
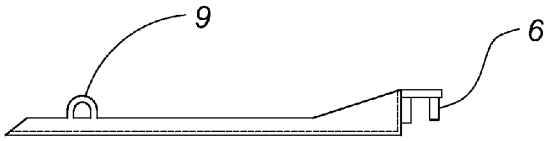
FIG. 5 is a side view of the base panel.

The present invention relates to a tray comprising a base panel 1 having an upper surface 2, a lower surface, a front edge 3, a rear edge 4 and two opposing side edges 5. Extending from the rear edge are a pair of U-shaped hooks 6 formed of a vertical leg 7 attached to the base panel and a pivotal, horizontal arm 8 with a pin 20 depending from an end thereof. On each side edge of the base panel is a ring 9 that is releasably gripped by suspenders 13 described in more detail, infra.

The device further includes a belt 10 having a pair of mating fasteners 47 thereon for adjustably securing the belt around a user's waist. On a rear section of the belt are eyelets 11 to which the suspenders 13 are secured while the front section includes a pair of grommets 14 that are dimensioned to firmly receive the pins 20 on the U-shaped hooks.

The suspenders include a pair of elongated straps 15 having a shoulder pad 16 on a central portion and a releasable J-hook 17 at each of two opposing ends. An adjustable band 18 extends between the two straps for varying the spacing therebetween to comfortably fit varying-sized users.

Accordingly, a user fastens the belt around the waist and secures one end of each strap to the eyelets on the back section. The straps are extended over the user's shoulders, adjusted and the other end is secured to the rings on the base panel. Therefore, the base panel will be firmly supported in a horizontal position, adjacent to the user's waist, allowing items to be conveniently transported thereon.

Figure 8:
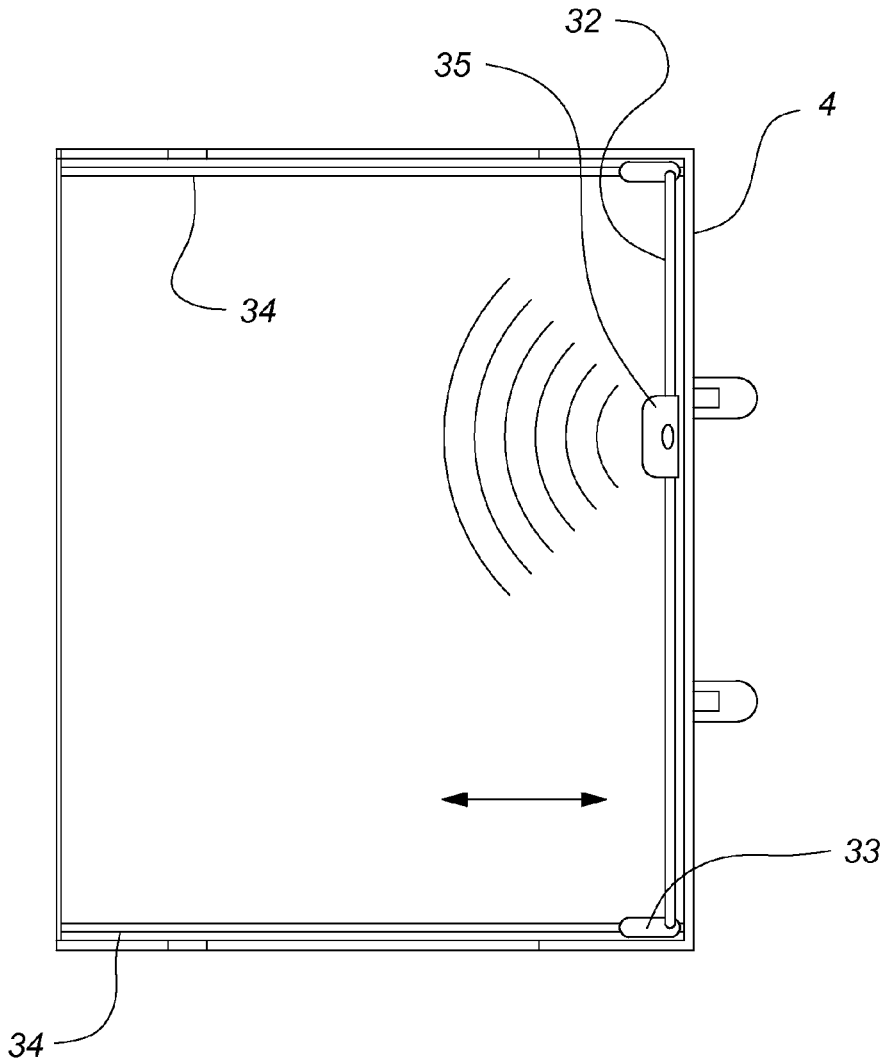
FIG. 8 is a top view of a slightly different embodiment of the tray according to the present invention.
Figure 9:
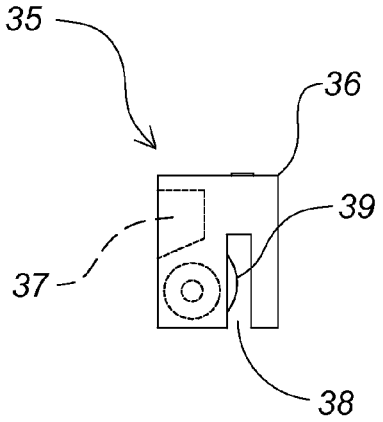
FIG. 9 is an isolated view of the LED module.
Figure 10:
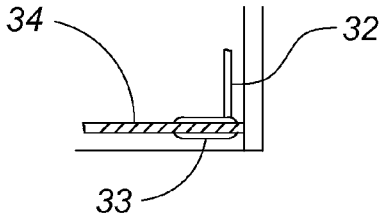
FIG. 10 is a sectional view of the tray of FIG. 8.

Now referring to FIGS. 8-10, the tray may also include a slidable divider for reducing the surface area of the base panel when supporting smaller objects or for restraining such objects during transport. The divider includes an elongated, vertical wall 32 having a bearing member 33 at each of two opposing ends. Each bearing member slidably engages a side rail 34 adjacent to one of the two side edges of the base panel. Accordingly, the divider can be moved along the upper surface of the base panel to form a smaller containment area for items in transit. Furthermore, the divider can be slid against an object to firmly trap it between the wall and the rear edge 4 of the base panel.

An LED module 35 is mounted on the wall to illuminate items resting on the base panel. The module includes a housing 36 having an exposed LED 37 on a front wall and a slot 38 on a bottom wall that is dimensioned to receive the upper edge of the divider wall. A spring 39 partially extending into the slot grips the wall to secure the housing thereto. When the divider is slid to the front edge of the base panel, the module may be easily removed, inverted and reattached to illuminate the entire tray.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A utility tray comprising:

a base panel having an upper surface, a lower surface, a front edge, a rear edge and two opposing side edges;

a belt having a pair of mating fasteners thereon for adjustably securing the belt around a user's waist, said belt having a front section and a rear section;

a pair of suspenders each having a first end and a second end, said first end attached to the rear section of the belt, said second end attached to said base panel;

means for pivotally attaching the rear edge of the base panel to the front section of said belt, wherein said means for pivotally attaching the rear edge of the base panel to the front section of said belt comprises a pair of U-shaped hooks extending from the rear edge of said base panel, said hooks each formed of a vertical leg attached to the base panel and a pivotal, horizontal arm with a pin depending from an end thereof, said pin removably received within a grommet on the front section of said belt.

2. The utility tray according to claim 1 further comprising an adjustable band extending between said pair of suspenders for varying a spacing therebetween to fit varying-sized users.

3. The utility tray according to claim 2 wherein said pair of suspenders each include a fastener on the second end that releasably grips a ring on one of said two opposing side edges of said base panel.

4. The utility tray according to claim 1 further comprising a divider slidably mounted on the upper surface of said base panel for reducing the surface area thereof to restrain small objects during transport.

5. The utility tray according to claim 4 wherein said divider comprises:

a first side rail adjacent to one of said two opposing side edges of said base panel;

a second side rail adjacent to another of said two opposing side edges of said base panel;

an elongated, vertical wall having two opposing ends;

a first bearing member at a first of said two opposing ends, said first bearing member slidably engaging said first side rail;

a second bearing member at a second of said two opposing ends, said second bearing member slidably engaging said second side rail allowing said wall to be moved along the upper surface of the base panel to restrain items resting thereon.

6. The utility tray according to claim 5 further comprising an LED module mounted on said wall to illuminate items resting on the base panel.

7. The utility tray according to claim 6 wherein said LED module includes a housing having an exposed LED on a front wall and a slot on a bottom surface, said slot receiving an edge of said wall.

* * * * *